US007124470B2

(12) United States Patent
Alanis

(10) Patent No.: US 7,124,470 B2
(45) Date of Patent: Oct. 24, 2006

(54) TOOL LANYARD

(75) Inventor: Isidro M. Alanis, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 10/443,029

(22) Filed: May 21, 2003

(65) Prior Publication Data

US 2004/0231101 A1 Nov. 25, 2004

(51) Int. Cl.
*E05B 1/00* (2006.01)

(52) U.S. Cl. ..... 16/110.1; 81/489

(58) Field of Classification Search ..... 16/110.1, 16/111.1, 428; 24/3.11–3.13, 3.1, 265 CD; 242/379, 279.2; 403/353; 81/489, 427.5, 81/180.1, 44

See application file for complete search history.

(56) References Cited

U.S. PATENT DOCUMENTS 765,605 A * 7/1904 Wade ..... 463/47.2
1,586,412 A * 5/1926 Curtis ..... 70/18
1,651,057 A * 11/1927 Goldstein ..... 482/82
2,253,075 A * 8/1941 Johnson ..... 482/82
3,934,873 A * 1/1976 Griffin ..... 473/424
4,322,077 A * 3/1982 Van't Hof ..... 473/551
4,455,023 A * 6/1984 Saloom ..... 463/47.2
4,502,181 A * 3/1985 Gonas ..... 16/445
4,616,868 A * 10/1986 Okuda ..... 294/137
4,624,276 A * 11/1986 Allen ..... 135/25.4
4,702,447 A * 10/1987 Westwood, III ..... 248/231.51
5,082,156 A 1/1992 Braun ..... 224/220
5,134,797 A * 8/1992 Turner ..... 42/85
5,209,090 A * 5/1993 Stillwagon ..... 70/456 R
5,363,680 A * 11/1994 Wu ..... 70/456 R
5,379,928 A * 1/1995 Mikkelsen ..... 224/257
5,445,479 A * 8/1995 Hillinger ..... 408/16
5,617,377 A * 4/1997 Perret, Jr. ..... 368/282
5,938,532 A * 8/1999 Wall ..... 463/47.2
5,988,828 A 11/1999 Prince et al. ..... 361/191
6,112,357 A * 9/2000 Halloran ..... 15/106
6,112,448 A * 9/2000 Gray et al. ..... 42/94
6,216,319 B1 4/2001 Elkins ..... 24/3.2
6,244,800 B1 * 6/2001 Studanski ..... 410/3
6,427,374 B1 * 8/2002 Vaiani ..... 42/85
6,487,756 B1 12/2002 Vidal, Jr. ..... 24/3.1
6,525,920 B1 * 2/2003 Rudoy et al. ..... 361/160
6,530,131 B1 3/2003 Hopkins ..... 24/300
6,767,169 B1 * 7/2004 Zhan et al. ..... 410/100

(Continued)

FOREIGN PATENT DOCUMENTS

DE 20019043 U1 * 1/2001

*Primary Examiner*—Robert J. Sandy
*Assistant Examiner*—Andre' L. Jackson
(74) *Attorney, Agent, or Firm*—Barnes & Thornburg LLP

(57) ABSTRACT

A tool having a lanyard, a tool member and structures for attaching the lanyard and the tool member. The attaching structures includes a pin that is engaged with the lanyard and the tool member. The tool defines an opening having a bore contiguous with the opening for receiving the pin. The opening is a slot and a pair of opposed first engaging surfaces define the slot and engaging portions of the loop to maintain the pin within the slot and bore. A lanyard including a loop received by the opening, the loop defining an eyelet receiving the pin to secure the lanyard to the tool member. Also disclosed is a method for releasably attaching a lanyard to a tool member.

13 Claims, 4 Drawing Sheets

U.S. PATENT DOCUMENTS 6,953,940 B1 * 10/2005 Leighley et al. ..... 250/455.11
2002/0174521 A1 11/2002 Vidal, Jr. ..... 24/3.1
2005/0115999 A1 * 6/2005 Johnson ..... 224/269

* cited by examiner

TOOL LANYARD

The present disclosure relates to a lanyard of a tool and more particularly to a lanyard that can be readily engaged with and removed from a tool.

BACKGROUND

Power tools and other tools often include lanyards to provide ease of handling of the tools. The lanyard is connected to the tool member and is engaged with the user, for example, so that it does not fall out of the user's hand if the user otherwise loses grip of the tool. The lanyard is especially useful if work is being performed, for example, on a ladder or otherwise at an elevated position.

One known way of attaching the lanyard to the tool member is by attaching a ring to the end of the lanyard and attaching the ring to the body with a screw. With this construction, the body is usually comprised of right and left halves that are secured together, and the ring is positioned between the right and left halves, with the screw passing through both halves.

SUMMARY

The present disclosure relates to a tool having a lanyard, a tool member and means for attaching the lanyard and the tool member. The attaching means includes a pin that is engaged with the lanyard and the tool member. The present disclosure also may relate to a method for attaching the lanyard to the tool member.

Additional features will become apparent to those skilled in the art upon consideration of the following detailed description of drawings exemplifying the best mode as presently perceived.

BRIEF DESCRIPTION OF THE DRAWINGS

The detailed description particularly refers to the accompanying figures in which.

DETAILED DESCRIPTION OF THE DRAWINGS

Figure 1:
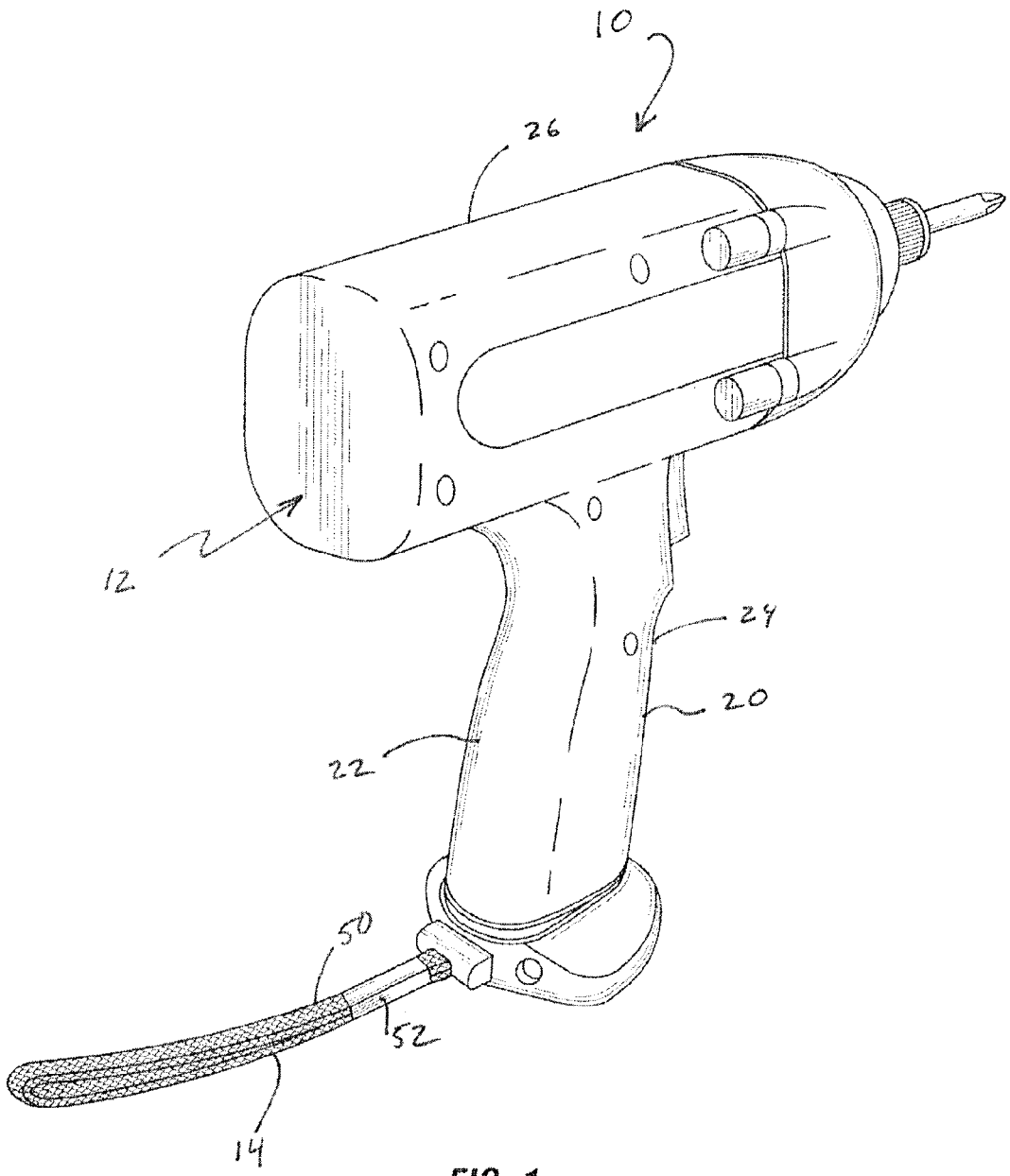
FIG. 1 is a perspective view of a tool having a lanyard in accordance with an embodiment of the present disclosure.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

Figure 2:
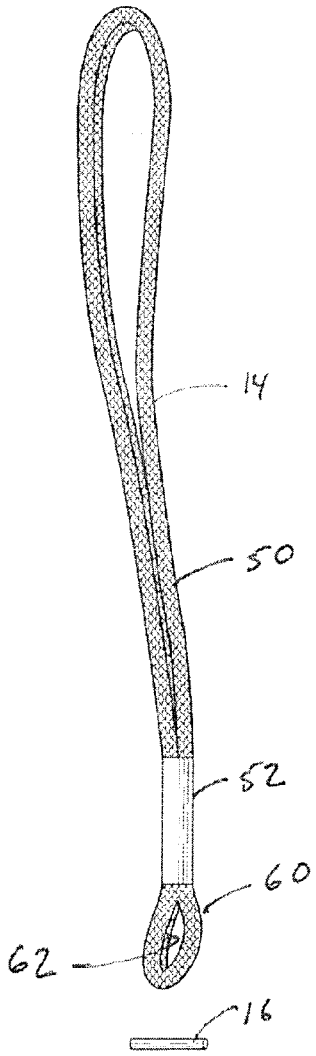
FIG. 2 is a perspective view of the lanyard and a pin for attaching the lanyard to the tool member of the tool of FIG. 1.
Figure 4:
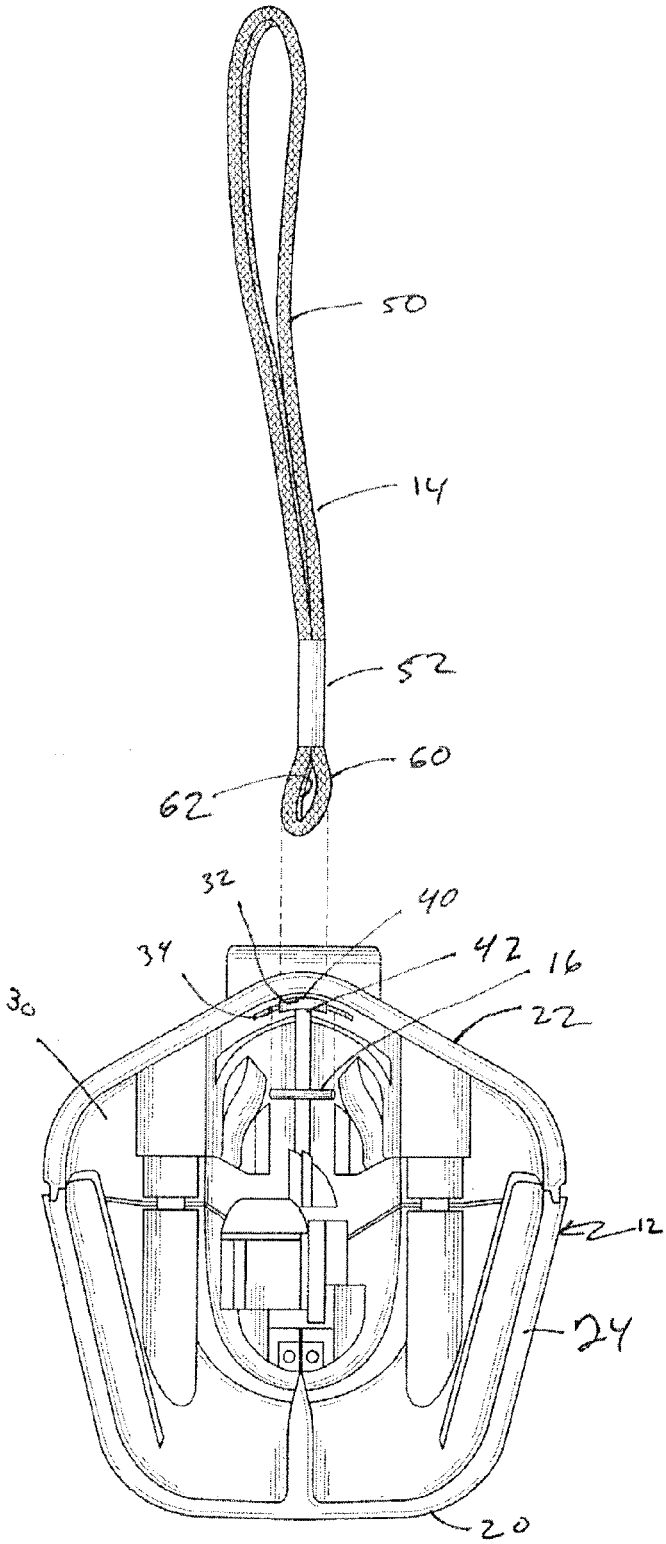
FIG. 4 is an exploded view of the bottom of the lanyard, pin and tool member of the tool of FIG. 1, illustrating the battery pack and bottom of the tool member removed.
Figure 3A:
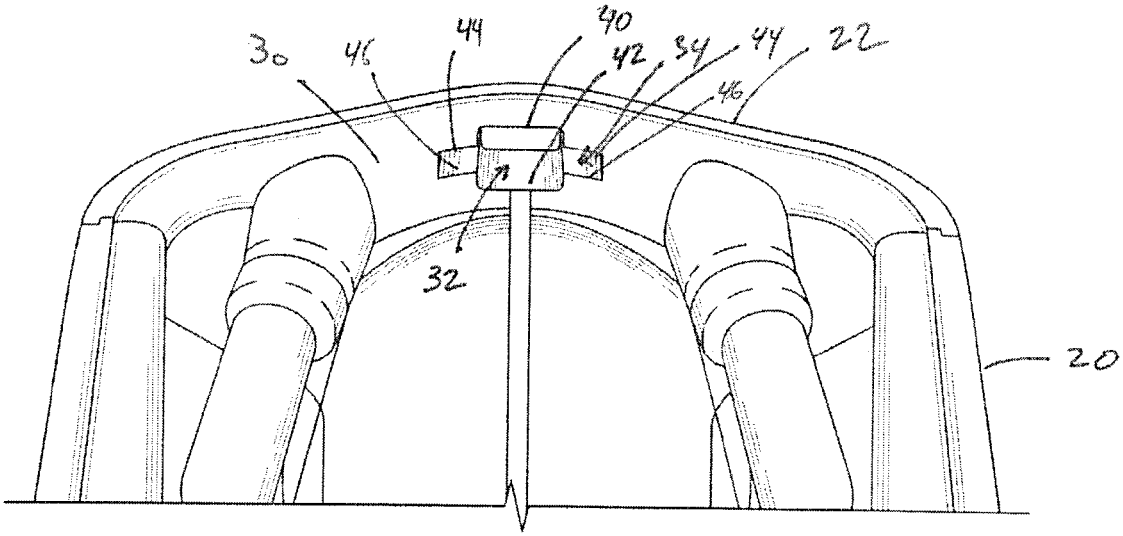
FIG. 3A is a partial perspective view of the bottom of the tool member of the tool of FIG. 1, with the lanyard and pin removed and with a battery pack also removed to illustrate a void defined by the tool member.
Figure 3B:
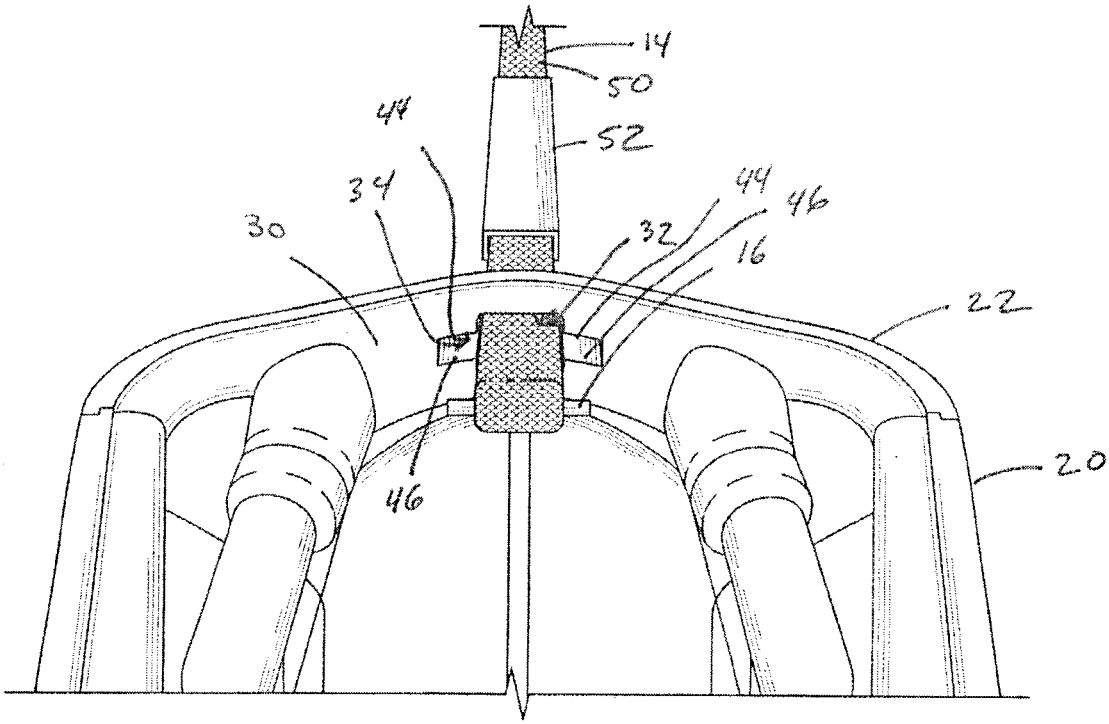
FIG. 3B is a partial perspective view similar to FIG. 3A, illustrating the lanyard being received by the slot defined by the tool member and engaging the pin within the void defined by the tool member.
Figure 3C:
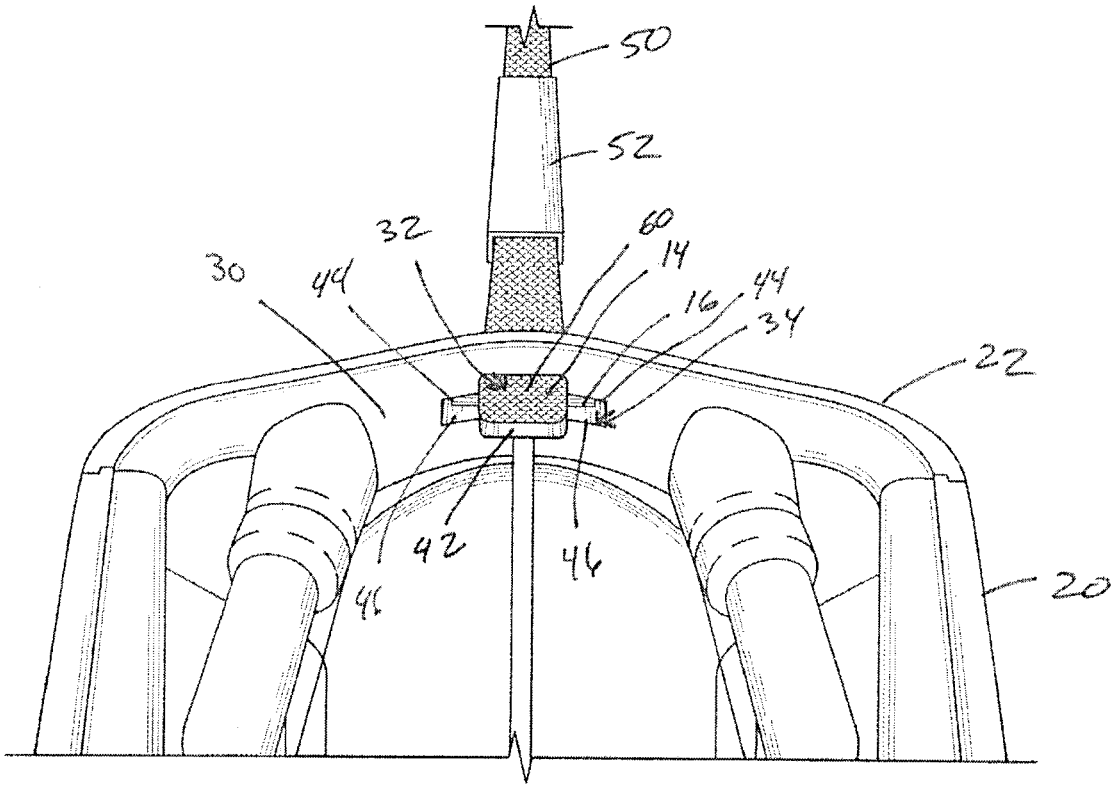
FIG. 3C is a partial perspective view similar to FIG. 3A, illustrating the pin received by the slot and bore defined by the tool member to secure the lanyard to the tool member.

FIGS. 1–4 illustrate a tool 10 including a tool member 12, a lanyard 14 and a retain in the form of pin 16 for attaching the lanyard to the tool member. The tool member 12 may be any suitable power tool or other tool and have any suitable construction. While the retainer 16 is shown in the drawings in the form of a pin, the retainer may be of any variety of shapes and sizes to produce the desired function as described below. As such, the retainer or means for retaining the lanyard may be in the form of a pin, plug, ring or any of a variety of shapes and structures to engage the lanyard 14 to retain it on the tool member 12. The tool member 12 is shown in the form of a tool housing but may be any other portion of a tool 10 such as a handle, grip, or any other structure to which the lanyard 14 may be attached using the structures to achieve the desired functions set forth herein. While a handle portion of the tool is referred to as the tool member 12 in the present illustrations, this could also be a handle portion of a tool such as a screw driver, wrench or other tool which is not powered. It is within the scope of the present application to include powered and powerless tools of any variety which would benefit from the use of a lanyard of the present construction and function.

The illustrated tool member 12, for example, is a power drill. The illustrated tool member 12 in the form of a tool housing includes front and rear members 20 and 22 that are joined together in any suitable manner to form a handle 24 and a barrel 26, and that define a void 30. The handle 24 defines a through slot 32 and a bore 34 contiguous with the slot. The slot 32 is defined by a pair of opposed first engaging surfaces 40 and 42 of the handle 24, and the bore 34 is defined by two pairs of opposed second engaging surfaces 44 and 46 disposed on opposite sides of the slot so that the bore and slot intersect. The opposed engaging surfaces 40 and 42 defining the slot 32 have a slight taper, so they diverge as they extend toward the void 30. The height of the slot 32 (which increases as the first engaging surfaces 40 and 42 extend toward the void 30) is greater than the height of the bore 34. The slot 32 is configured to receive the pin 16 and portions of the lanyard 14 disposed about the pin, and the bore 34 is configured to receive the pin. The slot 32 may be any other suitable opening, and the slot and the bore 34 may have any other configuration in accordance with other embodiments. The void 30 may also house a removable battery pack (not shown), or may instead house more or other items or no items. The void 30 may have any suitable configuration.

The lanyard 14 may have any suitable construction. The illustrated lanyard 14, for example, includes an endless flat cord 50 and a sleeve 52 disposed about two portions of the cord to form a loop 60 that defines an eyelet 62 to receive the pin 16. The loop 60 is configured to be received by the slot 32, so that the remainder of the cord 50 extends outside the void 30, and to receive the pin 16 within the eyelet 62. The pin 16 and the loop 60 are configured to then be received snugly within the slot 32 and the bore 34 with the first engaging surfaces 40 and 42 engaging the cord 50 to maintain the cord within the slot and the pin within the slot and the bore. The sleeve 52 may be constructed of metal or any other suitable material and may have any suitable configuration.

While the lanyard 14 above is described as being a generally endless flat cord 50 of a sleeve 52, the cord is generally joined at the sleeve 52. It is envisioned that other forms of the lanyard may be provided which may or may not use the sleeve 52 to divide the cord 50 to the smaller loop 60. In this regard, it is not required to form the loop 60 but it is envisioned that the lanyard may be a single loop of material. Additionally, the lanyard may be formed of any suitable material such as nylon, metal, plastic, or elastomeric materials. Additionally, it is envisioned that a variety of other devices may be attached to the lanyard 14 to enhance the use of the lanyard in combination with the tool 10. For example, a tightening device may be added to the extending portion of the lanyard 14 to allow the user to tighten the lanyard about their wrist. Such a tightening device may be a spring loaded barrel clamp of known construction. Nevertheless, the lanyard is designed for attachment to the tool member 12 for use by a user to hold or otherwise attach the tool 10 to the user. This will facilitate retaining the tool in close proximity to the user in the event that the user drops or otherwise loses grip of the tool.

Accordingly, in the illustrated embodiment, the lanyard 14 is readily secured to the tool member 12 and can be readily detached from the tool member. For example, to attach the lanyard 14, all or part of the loop 60 is inserted through the slot 32 and into the void 30 of the tool member 12. The pin 16 is inserted into the eyelet 62 within the void 30. The cord 50 is then pulled from outside the tool member 12 so that the pin 16 and portions of the loop 60 disposed about the pin are received by the slot 32 and the pin is received by the bore 34. The lanyard 14 is pulled until the first engaging surfaces 40 and 42 secure or otherwise engage the cord 50. To unsecure the lanyard 14, for example, the cord 50.

The remove the lanyard 14 from the tool member 10, the cord 50 may be pulled from the engaged end 60 such that the retainer 16 is disengaged from the engaging surfaces 40, 42. While this generally might be accomplished by gripping or otherwise engaging the lanyard 14 from the engaged end, this can also be accomplished by applying a force from the exposed end external to the tool member. This would apply a force from the exterior of the tool member inwardly toward the void 30.

It is also envisioned that the lanyard 14 may not include a specifically defined loop 60 but may be a strip of material in which the retainer 16 is inserted through the material. In this regard, the lanyard is engaged with the retainer 16 and the retainer 16 is engaged with the openings 32, 34. It is broadly envisioned to provide a lanyard 14 and a retainer 16 which is engageable with a tool member 12. Additionally, it is envisioned that the lanyard and retainer combination 14, 16 can be easily removed, generally without tools. However, it is desirable to provide the lanyard 14 and retainer 16 in a form which, while easily removable without tools, is not easily removable under ordinary operating conditions. In this regard, for example, when the tool 10 is not gripped by the user it may be dangling or otherwise attached to the user. For example, the lanyard may be clipped to the user's belt or other garments or may be carried on the user's wrist. When the tool 10 is not in use or in the suspended position, the lanyard 14 and retainer 16 combination tend to positively engage the tool member 12 to prevent unintended or accidental disengagement of the lanyard 14 and retainer 16 from the tool member 12. While the slot and bore 32, 34 combination has been described, these openings 32, 34 are to be broadly construed such that they provide passages which, while allowing a portion of the lanyard 14 to pass therethrough, positively engage the retainer 16. As described above, the retainer 16 is to be broadly interpreted to include, not only the pin 16 as shown in the illustrations, but any form of means for retaining the lanyard 14 in combination with the tool member 12.

The present disclosure also envisions a replacement lanyard and retainer or a replacement lanyard for use in combination with the tool. The replacement lanyard may be used to provide new lanyard in the event that the lanyard becomes damaged or otherwise unusable, to provide a different size of lanyard, or to provide a different style of lanyard. Also, it is envisioned that the retainer will be engaged or otherwise retained on the lanyard to provide a combined lanyard and retainer component. This may be usable to eliminate the possibility of losing the retainer which might otherwise be separate from the lanyard. However, it is also desirable to provide a retainer which is separate from the lanyard such that the retainer may not need to replaced by only the lanyard. It is envisioned that the lanyard, either with or without the retainer 16, can be sold or otherwise provided separate from the tool 10.

While a preferred embodiment of the disclosure is shown and described, it is envisioned that those skilled in the art may devise various modifications and equivalents without departing from the spirit and scope of the disclosure as recited in the following claims.

What is claimed is:

1. A tool comprising:

a tool member defining an opening;

a pin;

the tool member defines a bore contiguous with the opening for receiving the pin, the opening is a slot, the tool member includes a pair of opposed first engaging surfaces defining the slot and engaging portions of a loop to maintain the pin within the slot and bore, wherein the first engaging surfaces are tapered, and a lanyard including a loop received by the opening, the loop defining an eyelet receiving the pin to secure the lanyard to the tool member, at least a portion of the loop being retained in the opening with the pin extending through the loop and the pin being retained inside of the bore.

2. The tool of claim 1 wherein the bore is defined by two pairs of opposed second engaging surfaces disposed on opposite sides of the first engaging surfaces.

3. The tool of claim 1 wherein the lanyard includes a cord and a sleeve disposed about the cord forming the loop.

4. The tool of claim 1 wherein the tool member defines a void and the first engaging surfaces are tapered so that the slot increases in size as it extends towards the void.

5. The tool of claim 4 wherein the slot has two sides, one side being sized so that the pin cannot pass therethrough.

6. The tool of claim 5 wherein the pin is generally cylindrical.

7. A lanyard and retainer for use with a tool comprising:

a lanyard, a retainer, a tool having a wall and including a slot and a bore in the wall for receiving and retaining at least a portion of the lanyard and retainer therein, the bore extending along only a portion of the slot, the lanyard and retainer being engageable in the slot provided on the inside of the tool generally by inserting a portion of the lanyard through the slot in the tool and positioning the portion of the lanyard on the inside of the tool, the retainer extending through the bore and extending through only a portion of the slot;

the retainer engaging the lanyard; and at least a portion of the lanyard in the slot of the tool retaining the retainer generally within the tool.

8. The lanyard and retainer of claim 7, further comprising the retainer in the form of a pin and the lanyard providing a loop defining an eyelet, the pin being engageable in the eyelet of the loop of the lanyard and at least a portion of the lanyard and the pin extending through the eyelet being engageable with the slot in the tool.

9. The lanyard and retainer of claim 7, further comprising the retainer being captively retained on a portion of the lanyard.

10. The tool of claim 7 wherein the lanyard includes a cord and a sleeve disposed about the cord forming the loop.

11. The tool of claim 10 wherein the tool defines a void, the sleeve disposed outside the void.

12. A method for releasably attaching a lanyard to a tool member, the method comprising:

providing a lanyard;

providing a loop in at least a portion of the lanyard;

inserting the loop of a lanyard through a slot defined by the tool member and into a void defined by the tool member, the void being defined on an inside of the tool member such that the lanyard extends from outside the tool member into the void on the inside of the tool member, inserting a pin into an eyelet defined by the loop;

pulling the lanyard from outside the tool member so that the pin is received within the slot and a bore defined on an inside surface of the tool member generally in the void and contiguous with the slot;

retaining the pin and at least a portion of the lanyard in the tool.

13. The method of claim 12 further including tapered engaging surfaces defining the slot and engaging portions of the loop disposed about the pin to maintain the pin within the slot and the bore after the pulling.

* * * * *